US008327471B2

(12) United States Patent
Fielding, Jr. et al.

(10) Patent No.: US 8,327,471 B2
(45) Date of Patent: Dec. 11, 2012

(54) SEAT ASSEMBLY FOR A TOILET

(75) Inventors: Jerry Fielding, Jr., Brighton, MI (US); Roy L. Schooler, Brighton, MI (US)

(73) Assignee: Instantlid, Inc., Brighton, MI (US)

( * ) Notice: Subject to any disclaimer, the term of this patent is extended or adjusted under 35 U.S.C. 154(b) by 620 days.

(21) Appl. No.: 12/514,535

(22) PCT Filed: Nov. 26, 2007

(86) PCT No.: PCT/US2007/024414

§ 371 (c)(1),
(2), (4) Date: May 12, 2009

(87) PCT Pub. No.: WO2008/066799

PCT Pub. Date: Jun. 5, 2008

(65) Prior Publication Data

US 2010/0146688 A1 Jun. 17, 2010

Related U.S. Application Data

(60) Provisional application No. 60/867,256, filed on Nov. 27, 2006, provisional application No. 60/886,406, filed on Jan. 24, 2007.

(51) Int. Cl.
*A47K 13/12* (2006.01)
*A47K 13/00* (2006.01)

(52) U.S. Cl. ..... 4/236; 4/240; 4/237

(58) Field of Classification Search ..... 4/236, 240, 4/237

See application file for complete search history.

(56) References Cited

U.S. PATENT DOCUMENTS

| | | | | | |
|---|---|---|---|---|---|
| 1,975,570 | A | * | 10/1934 | Edgcumbe | 4/236 |
| 2,240,220 | A | * | 4/1941 | Leslie | 4/236 |
| 4,159,548 | A | * | 7/1979 | Hewson | 4/236 |
| 4,181,988 | A | | 1/1980 | Skaggs | |
| 4,514,356 | A | * | 4/1985 | Harrison | 264/328.12 |
| 5,414,875 | A | * | 5/1995 | Kappl et al. | 4/236 |
| 5,884,370 | A | * | 3/1999 | Bergamin | 24/71 SK |
| 6,018,825 | A | | 2/2000 | Enomoto | |
| 6,381,762 | B1 | * | 5/2002 | Moser | 4/240 |

FOREIGN PATENT DOCUMENTS

| | | | |
|---|---|---|---|
| JP | 10-085156 | A | 4/1998 |
| JP | 11-000287 | A | 1/1999 |
| KR | 20-0187447 | A | 4/2000 |

* cited by examiner

*Primary Examiner* — Dinh Q Nguyen
*Assistant Examiner* — Chee-Chong Lee
(74) *Attorney, Agent, or Firm* — Harness, Dickey & Pierce, P.L.C.

(57) ABSTRACT

A mounting assembly mounts a seat to a toilet having a base with a pair of mounting holes. The mounting assembly includes a base member and first and second members for insertion into first and second of the pairs of mounting holes, respectively. The first member is interconnected to the base member. The second member is interconnected to the base member and spaced apart from the first member by a distance. The distance between the first member and the second member is adjustable for creating a clamping force between the first and second members and the first and second mounting holes, respectively.

14 Claims, 7 Drawing Sheets

SEAT ASSEMBLY FOR A TOILET

CROSS-REFERENCE TO RELATED APPLICATIONS

This application claims priority to U.S. Provisional Patent Application Nos. 60/867,256 filed 27 Nov. 2006 and 60/886,406 filed 24 Jan. 2007, which applications are herein expressly incorporated by reference.

FIELD

The present teachings generally concern toilets. More particularly, the present teachings concern a seat assembly for a toilet including a mounting unit for securing the seat assembly to a toilet base.

BACKGROUND

Various arrangements are known for attaching a toilet seat the base of a toilet. Removal often requires various tools and discrete parts that may become lost or otherwise misplaced. Furthermore, removal and reattachment of a toilet seat typically requires the operator to access the bottom of bolts that pass through holes in a back flange of the toilet bowl. Such access is frequently awkward if not impossible given the limited working space available in most bathrooms.

To a much more limited extent, quick release arrangements for securing a toilet seat to a bowl are known. An example of such a quick release arrangement is shown in U.S. Pat. No. 6,381,762 which is hereby incorporated by reference as if fully set forth there. The arrangement includes a pair of fasteners each having a flange for engaging a toilet bowl when attached thereto and a head spaced above the flange. An anchor plate having a pair of slots formed on the bottom side thereof cooperates with the heads of the fasteners to secure the anchor plate to a toilet bowl. The anchor plate may include a latch for locking and unlocking the anchor plate from one of the fastener heads to permit the anchor plate to slide off of the fasteners and a pair of spaced hinge mounting supports extending from the anchor plate to which a toilet seat and lid may be pivotally coupled.

While known arrangements for attaching a toilet seat to the base of a toilet, including but not limited to arrangements discussed herein, may provide certain advantages, continuous improvement in the pertinent art remains desirable.

SUMMARY

In accordance with one aspect, the present teachings provide a mounting assembly for mounting a seat to a toilet. The toilet has a base with a pair of mounting holes. The mounting assembly includes a base member and first and second members for insertion into first and second of the pairs of mounting holes, respectively. The first member is interconnected to the base member. The second member is interconnected to the base member and spaced apart from the first member by a distance. The distance between the first member and the second member is adjustable for creating a clamping force between the first and second members and the first and second mounting holes, respectively.

Further areas of applicability will become apparent from the description provided herein. It should be understood that the description and specific examples are intended for purposes of illustration only and are not intended to limit the scope of the present disclosure.

DRAWINGS

The present teachings will become more fully understood from the detailed description, the appended claims and the following drawings.

DESCRIPTION OF VARIOUS ASPECTS

Figure 1:
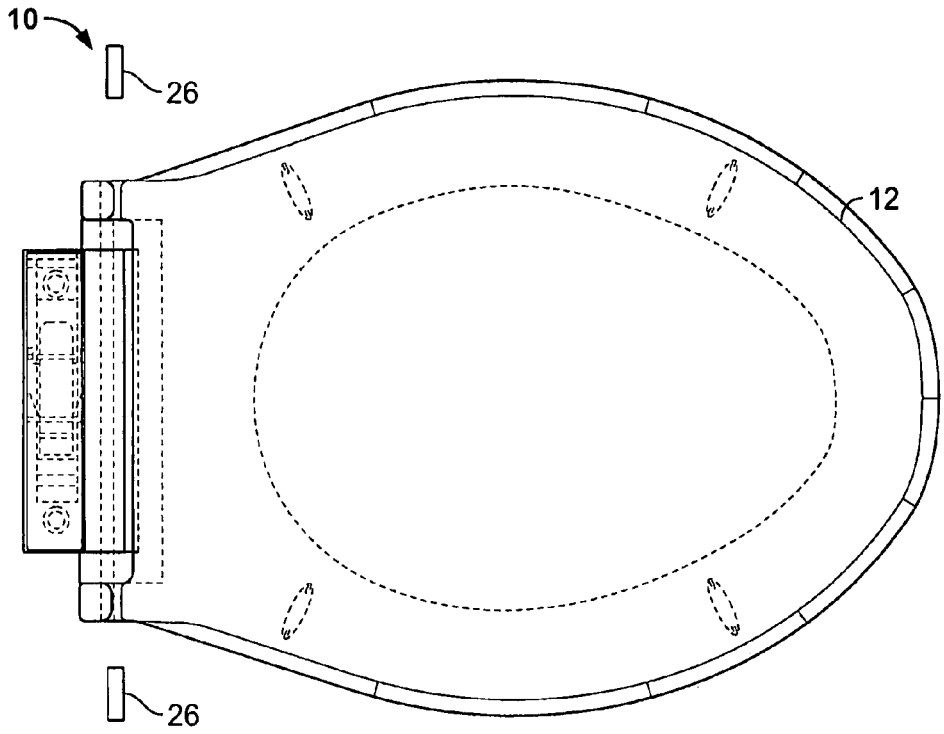
FIG. 1 is a top view of a toilet seat assembly in accordance with the present teachings.

The following description is merely exemplary in nature and is not intended to limit the present disclosure, application, or uses. It should be understood that throughout the drawings, corresponding reference numerals indicate like or corresponding parts and features. The description and any specific examples, while indicating embodiments of the present disclosure, are intended for purposes of illustration only and are not intended to limit the scope of the present disclosure.

With general reference to the drawings, a seat assembly for a toilet in accordance with the present teachings is illustrated and generally identified at reference character 10. The seat assembly 10 may generally include a seat 12 and a lid 14. The seat assembly 10 may further generally include a mounting unit or mounting arrangement 16 for mounting the seat assembly 10 to a toilet.

Figure 2A:
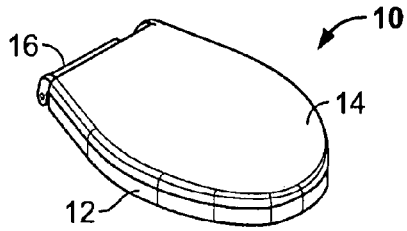
FIG. 2A is a perspective view of the toilet seat assembly in accordance with the present teachings, a lid of the assembly shown articulated to a closed position.
Figure 2B:
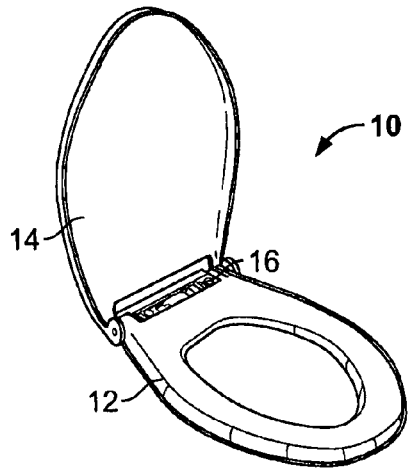
FIG. 2B is a perspective view of the toilet seat assembly in accordance with the present teachings, a lid of the assembly shown articulated to an open position.
Figure 3:
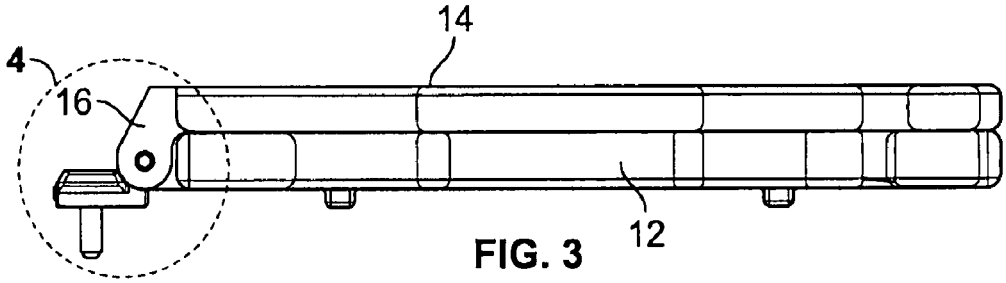
FIG. 3 is a side view of the toilet seat assembly in accordance with the present teachings.

As will become more apparent below, the mounting arrangement 16 may be operative for attaching the seat 12 and the lid 14 to the toilet for pivotal movement about a pivot axis A (see FIG. 2B). Accept as otherwise described herein, it will be understood that the seat 12 and lid 14 are conventional in both construction and operation. The mounting arrangement 16 may be used with various other seats and lids within the scope of the present teachings.

The mounting arrangement 16 may generally include a base portion or base member 18. The base portion 18 may be constructed of metal, plastic or any other material having suitable strength and durability characteristics. The base portion 18 may include a first portion or lower portion 20 and one or more mounting portions 22. As shown in the drawings, the one or more mounting portions may include a pair of mounting portions 22. The mounting portions 22 may be integrally formed with the lower portion 20 or be discrete portions suitably carried by the lower portion 20.

The mounting portions 22 may upwardly extend from the lower portion 20 and may define openings 24. The openings 24 may align with each other and with openings provided in the seat 12 and the lid 14. These aligning openings 24 may receive pivot pins 26 (see FIG. 1) which cooperate to define the pivot axis A. Through this pivot pin interconnection, the seat 12 and lid 14 may be rotated about the pivot axis A. The lid 14 is shown in a lowered position in FIG. 2A and in a raised position in FIG. 2B. The seat 12 may similarly be articulated between lowered and raised positions.

The mounting arrangement 16 may further include one or more hole engaging members 28. The hole engaging members 28 may function to engage conventional mounting holes (not particularly shown) defined in the base of a toilet. The hole engaging members 28 may include a first member 28A and a second member 28B. At least one of the first and second members 28A and 28B may be movably associated with the lower member 20 of the base portion 18. In one particular application, the first member 28A may be fixedly carried by the lower member 20 and the second member 28B may be movably carried by the lower member 20. In other applications, both of the first and second members 28A and 28B may be movably carried by the lower member 20.

The first and second members may be first and second pins 28A and 28B. The first and second pins 28A and 28B may be associated with sleeves 30. The sleeves 30 may be carried by shafts of the pins 28A and 28B and may be constructed of a flexible material. The outer diameters of the sleeves 30 may be sized to fit in the holes defined in the toilet base.

The first pin 28A may be received within an aperture 32 defined by the lower member 20. Alternatively, the first pin 28A may be integrally formed with the lower member 20. In this regard, a portion of the lower member 20 may be formed to be received within one of the apertures defined by the toilet base.

The base portion 18 may additionally include a translatable member 40. The translatable member or movable member 40 may be carried by the base portion 18 for movement between a first position (see FIG. 8B, for example) and a second position (see FIG. 8A, for example). The translatable member 40 may be received within tracks 42 defined by a pair of rails 44 of the lower member 20. The tracks 42 may be terminated by a slide cap 46. The slide cap 46 may be secured to the lower member 20 with a pair of pins 48.

The translatable member 40 may define an opening 50 for receiving the second pin 28B. Alternatively, the second pin 28B may be integrally formed with the translatable member 40. In this regard, a portion of the translatable member 40 may be formed to be received within one of the apertures defined by the toilet base.

The mounting arrangement 16 may further include a clamping arrangement 52. The clamping arrangement 52 may be operable to move the first and second pins 28A and 28B relative to one another. Explaining further, the clamping arrangement 52 may be operative for moving the translatable member 40 between the first position and the second position. In one application, the clamping arrangement 52 is operative for moving the first and second pins 28A and 28B toward one another. In other applications, the clamping arrangement 52 is operative for moving the first and second pins 28A and 28B away from one another.

The clamping arrangement 52 may including an over center latch having a latch handle 54 and a clamp clasp 56. The latch handle 54 may be coupled to the lower member 20 for movement about an axis B (see FIG. 6B, for example). Explaining further, the latch handle 54 may define a first pair of apertures 58 for receiving a pin 60. The pin 60 may pass through a pair of apertures 62 defined by the lower member 20.

The latch handle 54 may be coupled to the clamp clasp 56 with a pin 64. The pin 64 may pass through an opening 66 defined in an end of the clamp clasp 56 and pass through a second pair of apertures 68 defined by the latch handle 54. The pin 64 may define a pivot axis about which the clamp clasp 56 may rotate relative to the latch handle 54.

The clamp clasp 56 may be constructed of metal or other suitable material and may include a second end 70 for selectively engaging the translatable member 40. The second end 70 may be formed to include a hook for engaging a pin 72 carried by the translatable member 40. The pin 72 may be received within a pair of apertures 74 defined by the translatable member 40.

Figure 4:
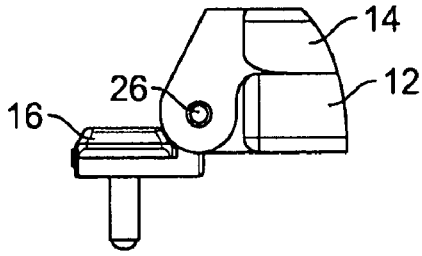
FIG. 4 is an enlarged view of the detail shown in circle 4 of FIG. 3.
Figure 5:
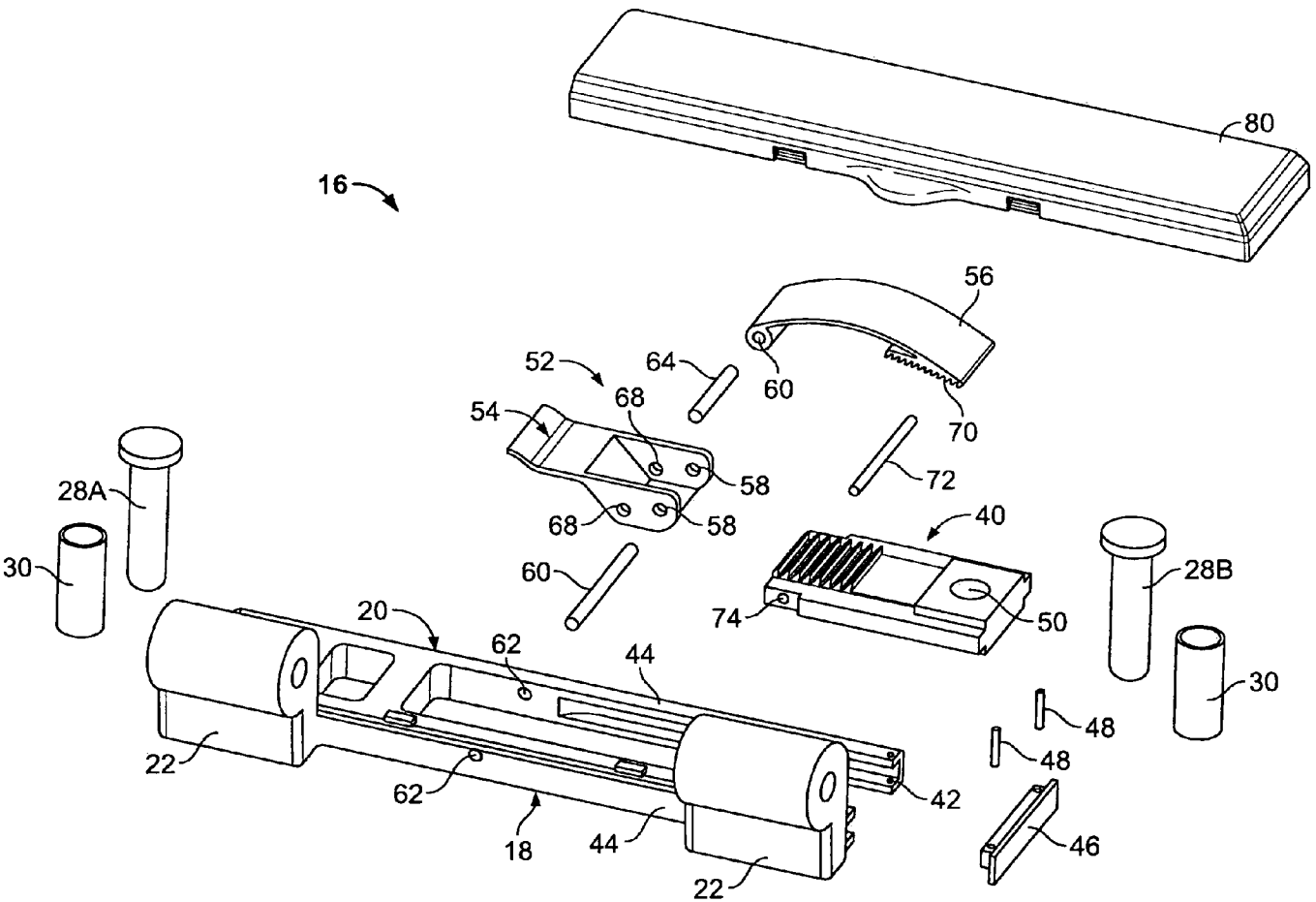
FIG. 5 is an exploded perspective view of a mounting unit of a toilet seat assembly in accordance with the present teachings.
Figure 6A:
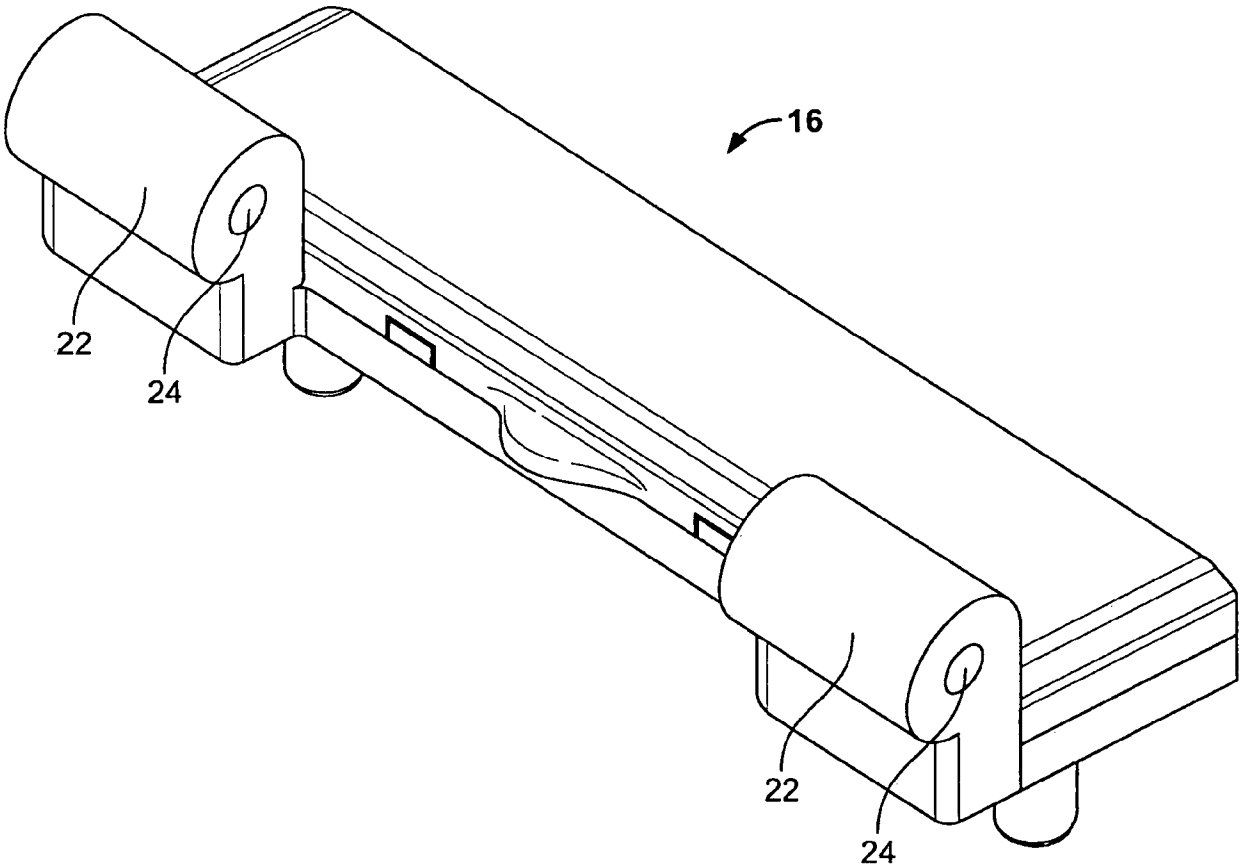
FIG. 6A is a perspective view of the mounting unit of a toilet seat assembly in accordance with the present teachings, the mounting unit shown with a cover articulated to a closed position.
Figure 6B:
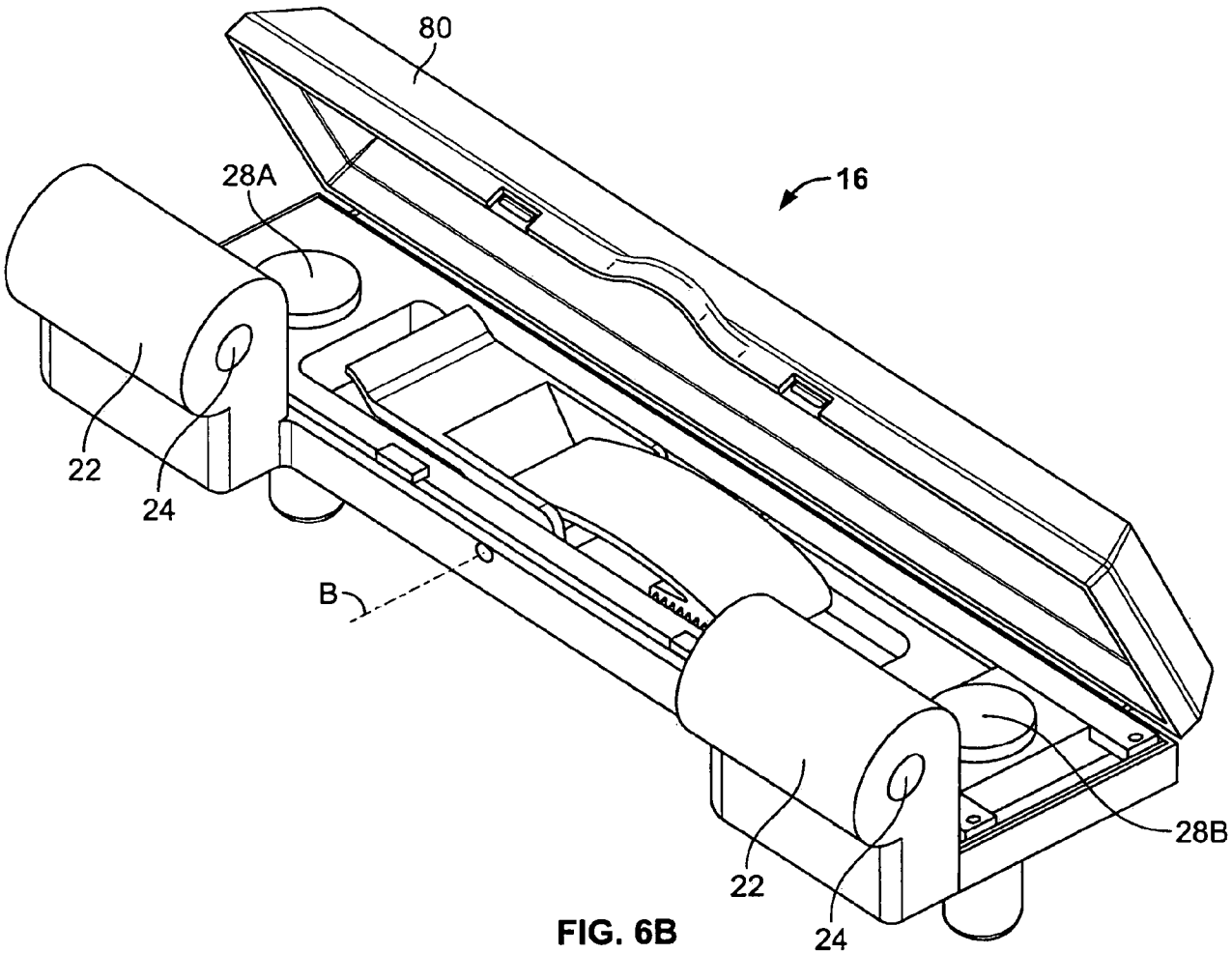
FIG. 6B is a perspective view of the mounting unit of a toilet seat assembly in accordance with the present teachings, the mounting unit shown with a cover articulated to an open position.
Figure 7:
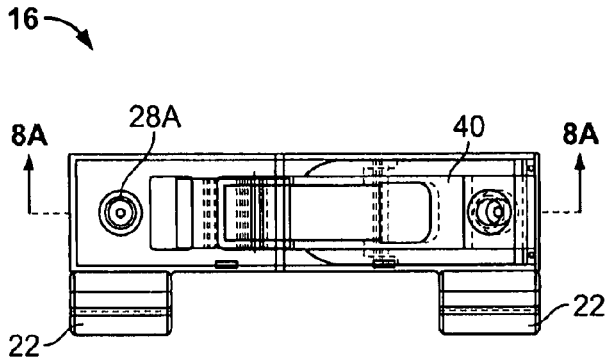
FIG. 7 is a top of the mounting unit of a toilet seat assembly in accordance with the present teachings.

The mounting arrangement 16 may further include a cover 80. The cover 80 may be connected to the lower member 20 for movement between an open position and a closed position. The open position is shown in FIG. 6B, for example. The closed position is shown in FIG. 4, for example.

Figure 8A:
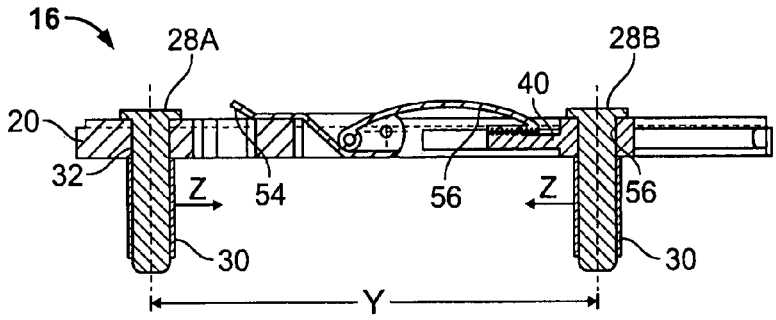
FIG. 8A is a cross-sectional view taken along the line 8A-8A of FIG. 7, the mounting unit shown in a locked condition.
Figure 8B:
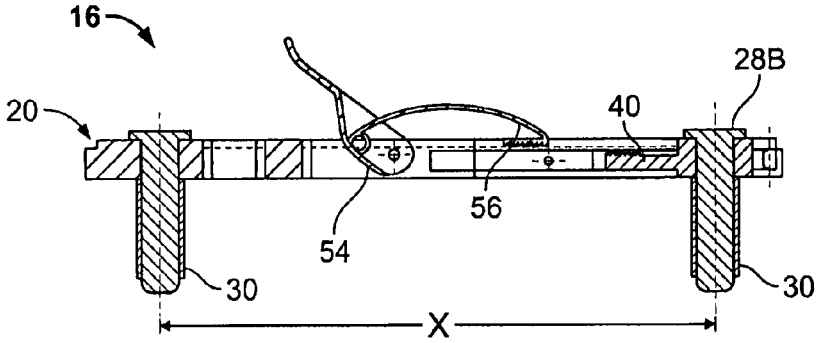
FIG. 8B is a cross-sectional view similar to FIG. 8A, the mounting unit shown in an unlocked condition.

In use, the latch handle 54 is rotated relative to the lower member 40 to a first position (as shown in FIG. 8B, for example). In this first position, the first and second pins 28A and 28B are spaced apart a first distance X and the mounting assembly 16 is in an unlocked condition. The first distance X is suitable for introducing the shafts of the first and second pins 28A and 28B into the holes defined by the toilet.

The seat assembly 10 is secured to the toilet through rotation of the latch handle 54 to a second position (as shown in FIG. 8A, for example). In this second position. The mounting assembly 16 is in a locked condition and the first and second pins 28A and 28B are spaced apart a second distance Y. This second distance Y may be slightly different than the first distance X such that the shafts of the first and second pins 28A and 28B apply a force against the inner walls of the holes defined by the toilet and thereby secure the seat assembly 10 to the toilet. In the application shown throughout the drawings, the applied forces of the first and second pins 28A and 28B are in the direction of arrows Z. Alternatively, these forces may be in opposite directions.

Figure 9:
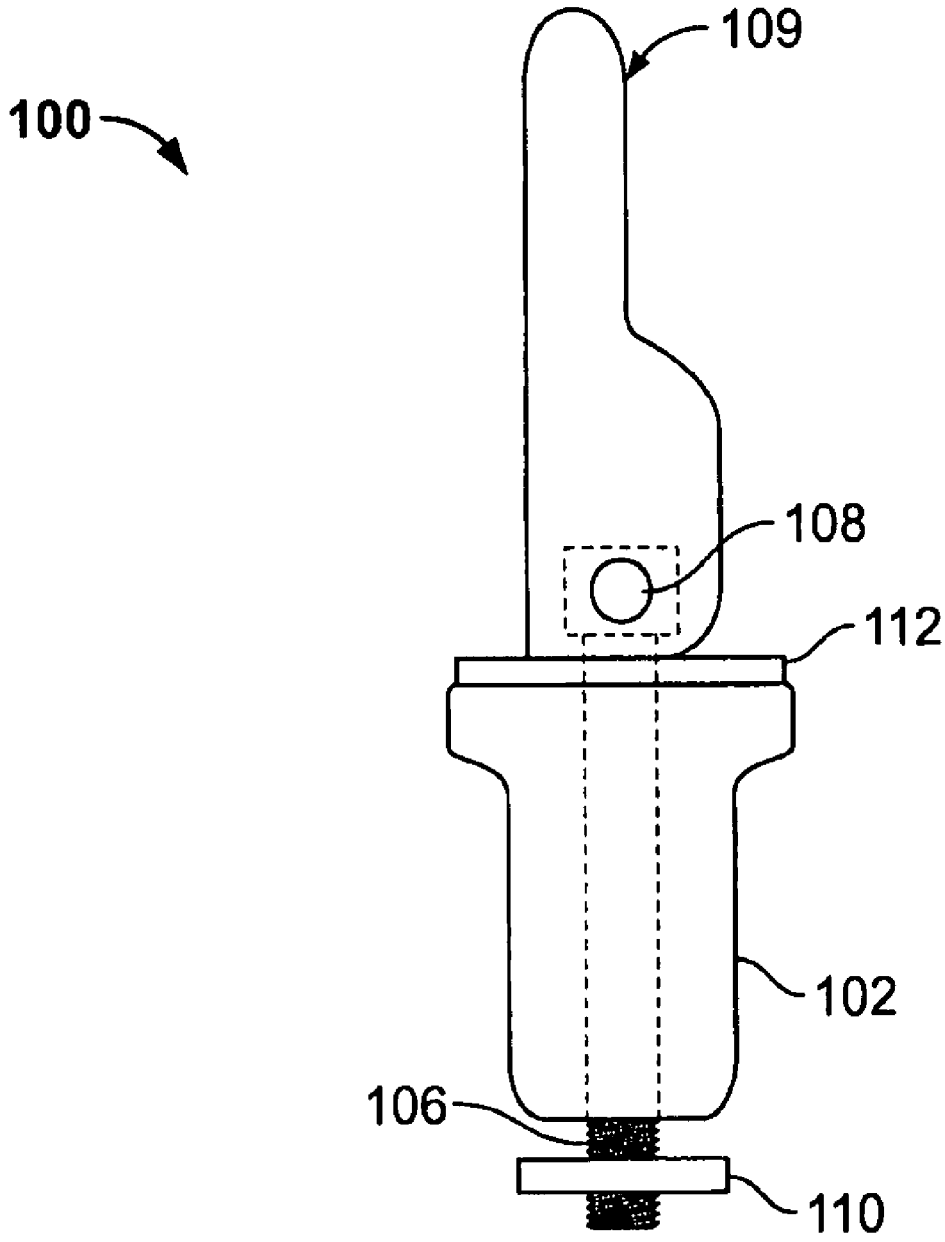
FIG. 9 is a side view of an alternative anchor in accordance with the teachings of the present disclosure.

Turning to FIG. 9, an alternative anchor 100 for use with the teachings of the present disclosure is illustrated. Distinct from the anchors discussed above, the anchor 100 may radially expand for attachment within one of the conventional mounting holes of a toilet base. The fastener 100 may include an expandable member 102. The expandable member 102 may be constructed of rubber or other suitable material. The expandable member 102 may additionally include an over-center latch 104 pivotally coupled to a rod 106 by a pin 108. The rod 106 may pass through an aperture defined by the expandable member 102, be threaded at a distal end and may threadably engage a washer 110. A second washer 112 may be positioned between the latch 104 and the expandable member.

The anchor 100 is shown in FIG. 9 in an unlatched condition. The latch 104 may be rotated clockwise (as shown in FIG. 9) about the pin 108 for purposes of compressing and thereby radially expanding the expandable member 102 between the washers 110 and 112. As such, the anchor 100 may be secured within the opening of the toilet base.

The teachings of the present disclosure may alternatively incorporate various types of blind fasteners. As used herein, the term "blind fastener" shall mean any fastener that may be inserted into a conventional hold of a toilet base from the upper side of the hold and secured to the base without a need to access the lower side of the hole.

Accordingly, a seat assembly 10 is disclosed which may be secured to a toilet without the need of accessing fastener components on an underside of the toilet. In this regard, the seat assembly 10 may be easily and quickly installed by a user without the need of the user to lie on the floor or otherwise access the underside of a portion of the toilet. The seat assembly 10 further operates to more securely fasten the seat 12 to the toilet as compared to known mounting arrangements.

While specific examples have been described in the specification and illustrated in the drawings, it will be understood by those skilled in the art that various changes may be made and equivalence may be substituted for elements thereof without departing from the scope of the present teachings as defined in the claims. Furthermore, the mixing and matching of features, elements and/or functions between various examples may be expressly contemplated herein so that one skilled in the art would appreciate from the present teachings that features, elements and/or functions of one example may be incorporated into another example as appropriate, unless described otherwise above. Moreover, many modifications may be made to adapt a particular situation or material to the present teachings without departing from the essential scope thereof. Therefore, it may be intended that the present teachings not be limited to the particular examples illustrated by the drawings and described in the specification as the best mode of presently contemplated for carrying out the present teachings but that the scope of the present disclosure will include any embodiments following within the foregoing description and any appended claims.

The invention claimed is:

1. A mounting assembly for mounting a seat to a toilet, the toilet having a base with a pair of mounting holes, the mounting assembly comprising:

a base member;

a translatable member coupled to the base for linear translation relative to the base, the translatable member defining a pair of flanges received within a pair of grooves defined by the base member;

a first member for insertion into a first of the pair of mounting holes, the first member interconnected to the base member; and a second member for insertion into a second of the pair of mounting holes, the second member carried by the translatable member and spaced apart from the first member by a distance;

wherein the distance between the first member and the second member is adjustable for creating a clamping force between the first and second members and the first and second mounting holes, respectively.

2. The mounting assembly of claim 1, wherein the first member is fixed relative to the base member and the second member is translatable relative to the base member.

3. The mounting assembly of claim 1, wherein the distance between the first and second members is decreased to creative the clamping force between the first and second members and the first and second mounting holes.

4. The mounting assembly of claim 1, further comprising a handle for moving the translating member from a first position to a second position to adjust the distance between the first and second members.

5. The mounting assembly of claim 4, wherein the handle is mounted to the base for rotation about an axis, the axis being generally perpendicular to the distance.

6. The mounting assembly of claim 5, further comprising a clamp coupled to the handle and a second end for releasable engaging the translating member.

7. The mounting assembly of claim 6, wherein the second end of the clamp defines a first plurality of teeth and the translating member defines a second plurality of teeth for meshingly engaging the first plurality of teeth.

8. The mounting assembly of claim 1, in combination with the seat assembly, the seat assembly coupled to the mounting assembly.

9. The mounting assembly of claim 1, wherein the translatable member is received within tracks defined by a pair of rails of the base member.

10. A mounting assembly for mounting a seat to a toilet, the toilet having a base with a pair of mounting holes, the mounting assembly comprising:

a base member;

a translatable member coupled to the base for linear translation relative to the base;

a first member for insertion into a first of the pair of mounting holes, the first member interconnected to the base member;

a second member for insertion into a second of the pair of mounting holes, the second member carried by the translatable member and spaced apart from the first member by a distance, the distance between the first member and the second member being adjustable for creating a clamping force between the first and second members and the first and second mounting holes, respectively;

a handle for moving the translating member from a first position to a second position to adjust the distance between the first and second members; and a cover attached to the base member for movement between an open position and a closed position, the cover being independent from the handle.

11. The mounting assembly of claim 10, wherein the cover covers the handle in the closed position.

12. A mounting assembly for mounting a seat to a toilet, the toilet having a base with a pair of mounting holes, the mounting assembly comprising:

a base member;

a translatable member coupled to the base for linear translation relative to the base;

a first member for insertion into a first of the pair of mounting holes, the first member interconnected to the base member; and a second member for insertion into a second of the pair of mounting holes, the second member carried by the translatable member and spaced apart from the first member by a distance, the distance between the first member and the second member being adjustable for creating a clamping force between the first and second members and the first and second mounting holes, respectively; and a handle for moving the translating member from a first position to a second position to adjust the distance between the first and second members;

wherein the translatable member includes a first end for releasably engaging the handle and a second end defining an opening for receiving the second member.

13. The mounting assembly of claim 10, wherein the translatable member defines a pair of flanges received within a pair of grooves defined by the base member.

14. A mounting assembly for mounting a seat to a toilet, the toilet having a base with a pair of mounting holes, the mounting assembly comprising:

a base member including a pair of spaced apart rails, each rail defining a groove;

a translatable member coupled to the base for linear translation relative to the base, the translatable member including a pair of flanges slidingly received within the pair of grooves, the translatable member including a first end with a plurality of teeth and a second end with a hole;

a first member for insertion into a first of the pair of mounting holes, the first member interconnected to the base member;

a second member for insertion into a second of the pair of mounting holes, the second member carried by the translatable member, passing through the hole of the translatable member, and spaced apart from the first member by a distance;

a handle for moving the translatable member from a first position to a second position, the handle pivotally coupled to the base; and a clamp clasp having a first end pivotally coupled to the handle and a second end for releasably engaging the teeth of the translatable member;

wherein the distance between the first member and the second member is adjustable for creating a clamping force between the first and second members and the first and second mounting holes, respectively.

* * * * *